United States Patent [19]

Ekholm et al.

[11] 4,025,395

[45] * May 24, 1977

[54] METHOD FOR QUENCHING COKE

[75] Inventors: LaVerne G. Ekholm, McKeesport; Bernard R. Kuchta, Plum Borough; Joseph P. McGinness, McKeesport, all of Pa.

[73] Assignee: United States Steel Corporation, Pittsburgh, Pa.

[ * ] Notice: The portion of the term of this patent subsequent to Apr. 23, 1991, has been disclaimed.

[22] Filed: Mar. 24, 1975

[21] Appl. No.: 561,390

Related U.S. Application Data

[63] Continuation of Ser. No. 442,709, Feb. 15, 1974, which is a continuation-in-part of Ser. No. 168,659, Aug. 3, 1971, Pat. No. 3,806,425.

[52] U.S. Cl. ..... 201/39; 202/227

[51] Int. Cl.[2] ..... C10B 39/08

[58] Field of Search ..... 202/227, 230, 228, 229, 202/253, 263, 95; 201/39

[56] References Cited

UNITED STATES PATENTS

| | | | |
|---|---|---|---|
| 956,397 | 4/1910 | Mitchell et al. | 202/227 |
| 1,121,376 | 12/1914 | Koppers | 202/229 |
| 1,206,588 | 11/1916 | Piez | 202/227 |
| 1,541,621 | 6/1925 | Carini | 202/227 |
| 2,837,470 | 6/1958 | Hayden | 202/227 |
| 3,806,425 | 4/1974 | Ekholm et al. | 202/227 |

*Primary Examiner*—Wilbur L. Bascomb, Jr.
*Attorney, Agent, or Firm*—William L. Krayer

[57] ABSTRACT

An improved method of rapid liquid quenching of coke wherein hot coke is distributed on a surface, preferably an inclined surface, and a substantially uniform stream of quench liquid is flowed through said hot coke at spaced apart locations so that the quench liquid penetrates the depth of the bed prior to complete vaporization and percolates through the bed quenching coke as it goes. Particularly good results are obtained by oscillating the stream or streams slowly over the coke.

3 Claims, 9 Drawing Figures

METHOD FOR QUENCHING COKE

RELATED APPLICATION

This is a continuation, of application Ser. No. 442,709, filed Feb. 15, 1974, which is a continuation-in-part of Ser. No. 168,659, now U.S. Pat. No. 3,806,425.

BACKGROUND OF THE INVENTION

Not metallurgical coke pushed from slot type coke ovens is usually immediately quenched by spraying it with a large volume of water. The hot coke from the ovens is conveyed on a quenching car to a spray quenching station where the car and its contents are drenched with water by spraying water over the whole surface of the coke until it is quenched. This method often results in excessive quenching of some areas and leaves up to 20% moisture in the cold porous coke.

It is very desirable to have the moisture level in coke within the range of 2–4%. At levels below 2% the coke tends to form a powdery dust in handling and at moisture levels above about 4%, the transportation costs due to shipping the excessive water are quite high. The most important disadvantage, however, with the heretofore employed quenching methods is that the variability of moisture in coke increases as the average moisture content increases so that one gets erratic blast furnace performance from the use of the coke as the exact amount of carbon is difficult to calculate.

It is therefore an object of this invention to provide a method of quenching coke which will reduce the moisture content to an acceptable level below that obtainable by conventional quenching methods and to obtain are uniform moisture content at the low level. A further object of this invention is to provide a method of reducing the time required to quench the coke in car load quantities. Another object of this invention is to reduce the amount of water required to quench a coke load and thereby decrease the amount of water being discharged to the atmosphere.

SUMMARY OF THE INVENTION

The foregoing objects and others which will become apparent from the attached drawings and the following description are accomplished in accordance with this invention by providing a method for the rapid liquid quenching (usually water) of hot coke by distributing the hot coke on a quenching surface which is preferably inclined 25° to 35° from horizontal to form a bed of coke and flowing a stream of quench liquid through the bed of coke at spaced apart locations so that the quench liquid penetrates the bed prior to complete vaporization and rapidly quenches the coke as the vapor and liquid percolate in all direction through the surrounding bed. In has in fact been found beneficial to dump substantially uniform stream of quench liquid onto the upper 50% of the surface area of a bed of coke on an inclined plane quench surface. The stream penetrates the bed of coke, diffuses down through the hot coke and then flows down the inclined plane quench surface beneath the hot coke until it comes in contact with unquenched coke and then percolates through the bed of hot coke quenching it as it goes. The method of this invention is quite contrary to the supposed and often asserted need for uniform spraying over the bed of coke which has been proposed heretofore. Contrary to the prior teaching shorter quench times yielding coke with uniform low moisture are obtained by quenching over less than the whole surface area with a stream of quench liquid instead of a spray. The stream should not be greatly diffused before it strikes the surface of the coke so that penetration into the bed to a depth of as much as 8 feet is obtained before complete vaporization. In the prior practice whereby the quench liquid is sprayed over the entire bed of the coke, the vaporization is often so forceful that droplets of quench liquid are carried up in the quench tower without ever contacting the coke. In the stream quench method of the present invention the quench liquid penetrates the bed to a substantial depth and quenches more effectively as shown by shorter quench times and lower residual moisture contents in the quenched coke.

DETAILED DESCRIPTION

Figure 3:
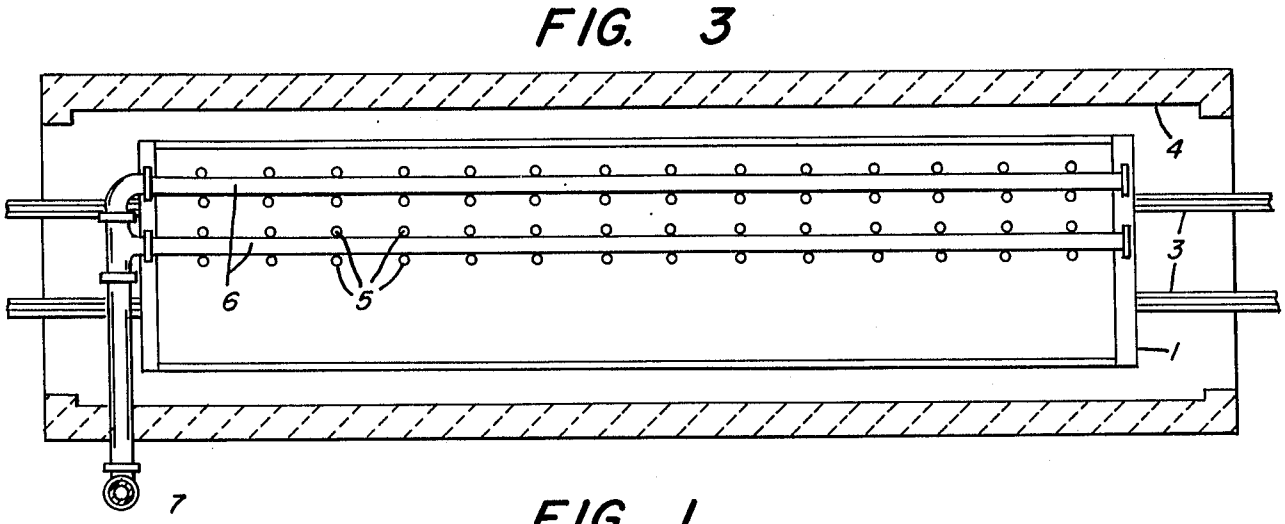
FIG. 3 is a top plan view taken along line III—III of FIG. 1.
Figure 2:
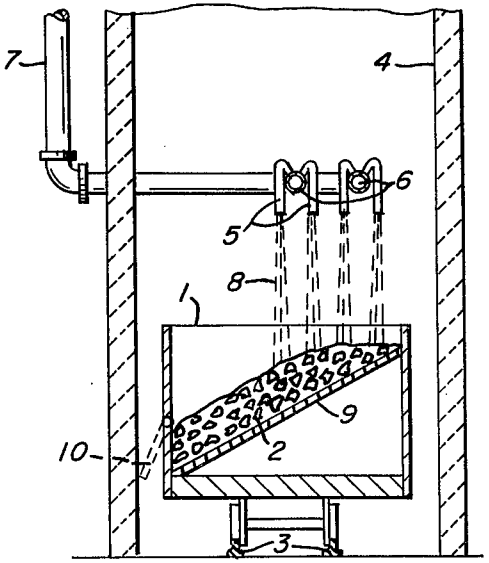
FIG. 2 is a vertical sectional view taken along line II—II of FIG. 1.
Figure 1:
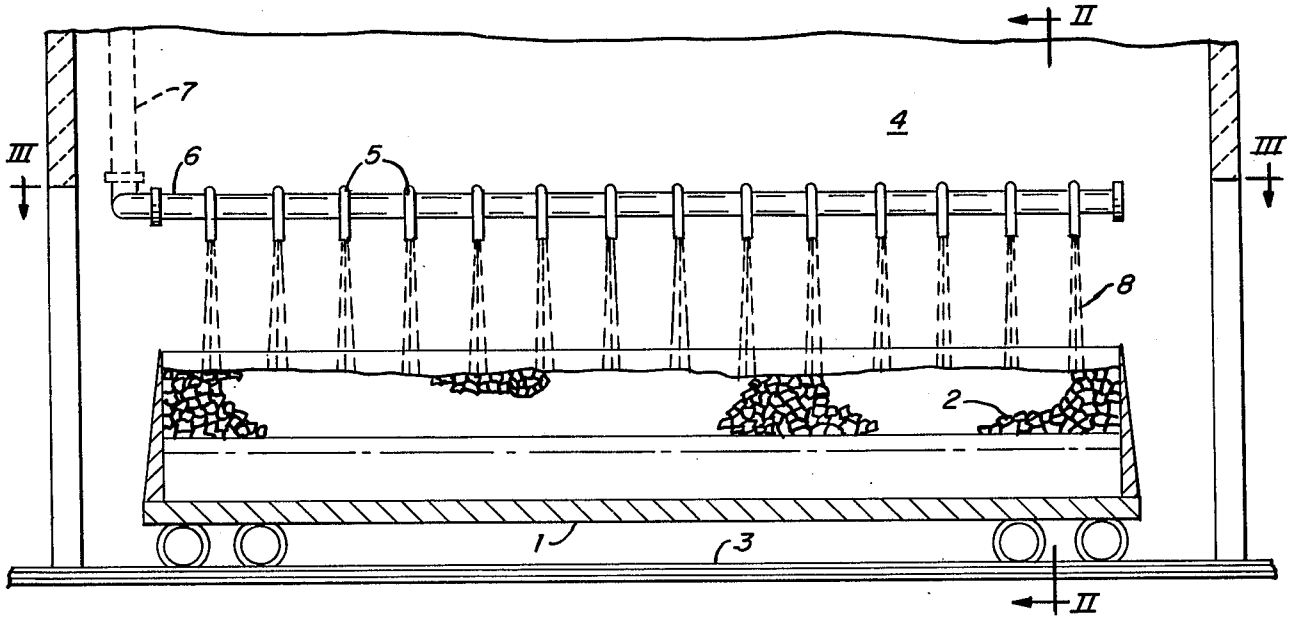
FIG. 1 is a vertical sectional view of a stream quenching station of the invention showing a hot coke car beneath a plurality of stream of quench liquid.
Figure 8:
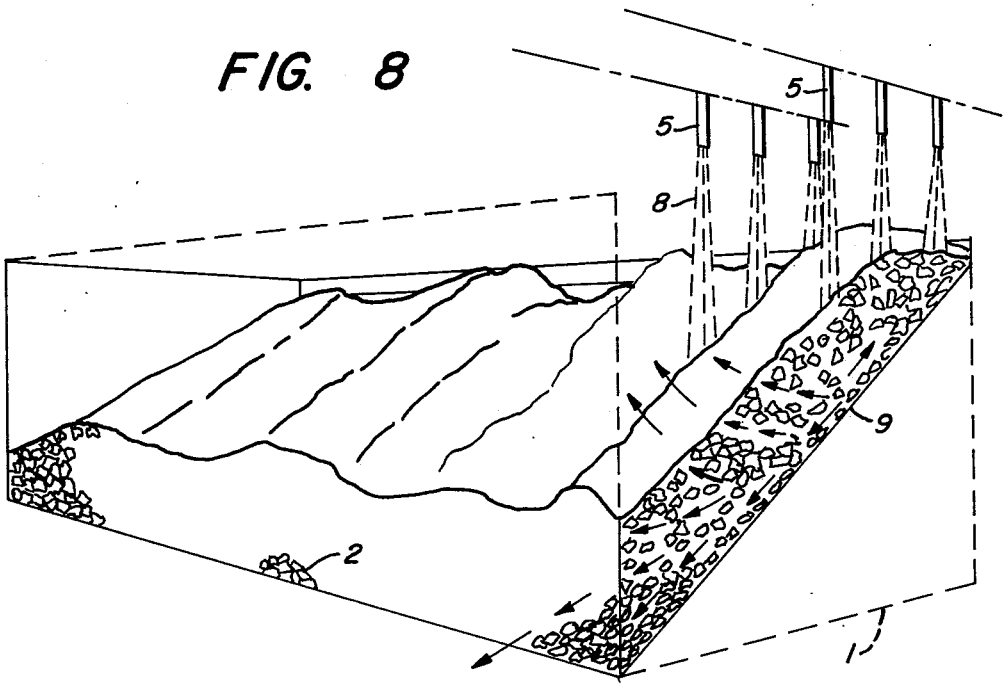
FIG. 8 is a diagrammatic perspective view showing the flow of quench liquid through a bed of coke.

Referring to FIGS. 1 and 2 of the drawing, car, 1, filled with hot coke, 2, to a mean depth of about 3 feet is rolled along tracks, 3, under a quenching hood, 4, equipped with a plurality of downwardly directed 1½ inch pipes, 5, connected by header, 6, to a quenching liquid reservoir (not shown), by connecting main 7. As shown in FIG. 2 substantially all of the quench liquid, 8, is deposited in about one minute an soon as car, 1, is in position under hood, 4, on the upper portion of the bed of coke, 2, as it rests on inclined surface, 9. Coke, 2, will be completely quenched and free of "hot spots" i.e., areas capable of self-supporting combustion in air, in about one minute and car 1 may be removed to a coke wharf (not shown) and coke containing about 3 by weight uniform moisture content discharged through gate, 10. With reference to FIG. 8, quench liquid deposited on the upper side of the inclined bed of coke 2 penetrates the bed to bottom surface 9 and flows in the direction of the arrows until it contacts hot coke where it percolates in the direction shown and often escapes through the surface of the bed and impinges on the side of car 1. Some of the quench liquid may flow down inclined bottom surface, 9, and out beneath gate, 10.

Figure 4:
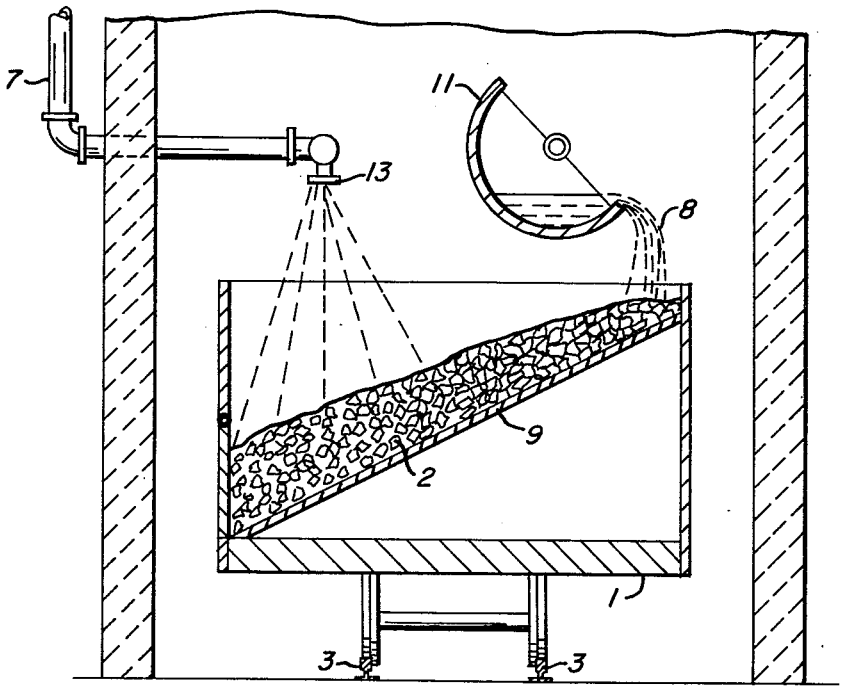
FIG. 4 is a vertical sectional view of a coke quenching station and alternate apparatus for the stream quenching method of the invention.
Figure 5:
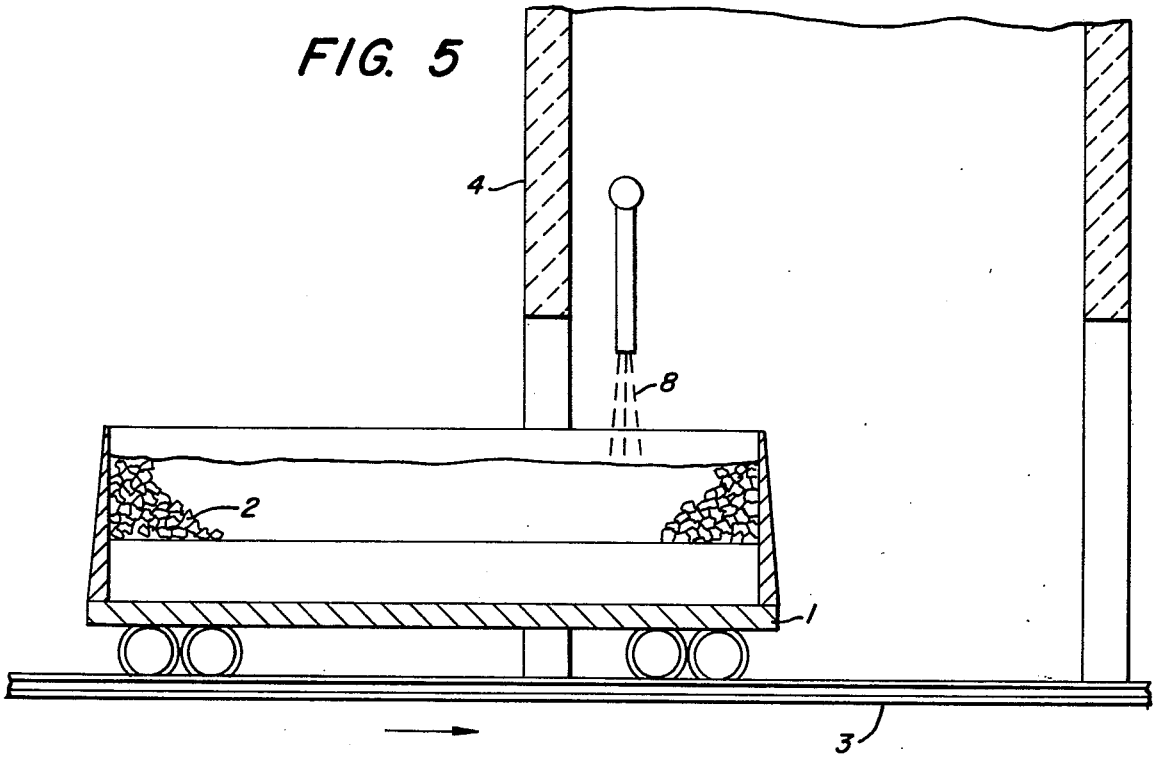
FIG. 5 is a vertical sectional view shown single stream quenching by moving the hot car beneath a single discharge of quenching liquid.

Alternate embodiments are shown in FIGS. 4 and 5. In the apparatus illustrated in FIG. 4, quench liquid, 8, is dumped from reservoir, 11, onto the upper portion of an inclined bed of coke and flows down through the coke to bottom surface, 9, and percolates upward analogous to the diagram of FIG. 8. It is possible, but not essential, as discussed below, to include a plurality of spray nozzles, 13, to spray quench liquid over the bed of coke as shown in FIG. 4. As shown in FIG. 5, quench liquid is discharged through a single large diameter pipe, 12, onto the high side of the bed of coke as the hot coke car, 1, is pushed along track 3 under the quench hood, 4, in the direction indicated by an arrow.

Figure 6:
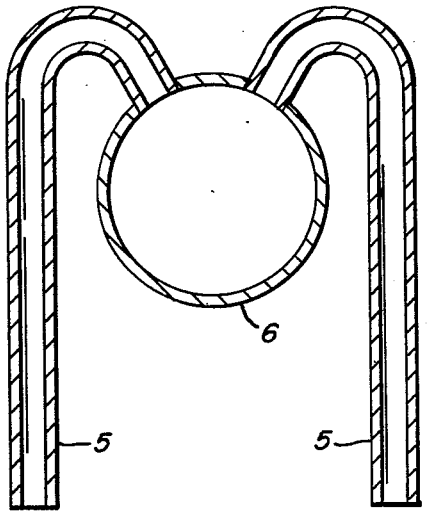
FIG. 6 is an enlarged cross-sectional end view of a header and flow pipe design for multiple stream quenching.
Figure 7:
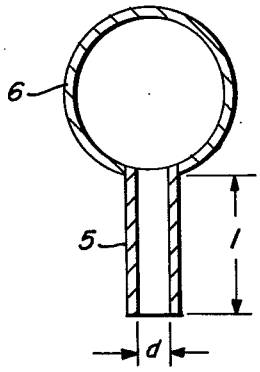
FIG. 7 is an enlarged cross-sectional end view of a single stream header and pipe design showing the relationship between diameter and length of pipe.

Many different types of pipe arrangements as well as other systems, for example, as illustrated in FIG. 4, are possible for flowing quench liquid rapidly through the bed of coke so that it will percolate up through the bed. It is sometimes desirable to use a configuration as shown in FIG. 6 where pipes, 5, leave header, 6, from the upper side. Such a configuration avoids the possibility of plugging due to coke breeze and other particles becoming lodged in the pipes, an insurance that the flow from the pipes will be uniform and occur simultaneously. However, as shown in FIG. 7, so long as the straight length, 1, of the pipe, 5, extending from header 6 is at least three times and preferably at least 8 times the diameter, d, a satisfactory stream for penetration of the bed of coke will be obtained.

Generally speaking the invention is applicable to quenching any hot relatively porous material where short quench times are essential to achieve low residual moisture content, but the invention is particularly adapted to the quenching of hot coke from slot type coke ovens. When hot coke is pushed from slot type ovens into a quench car it does not fall in a uniform evenly spaced pattern to form a level bed of coke. Instead, the coke, at a temperature of about 1800°–2100° F and having a density of about 27–33 lbs/ft$^3$, falls into the moving quench car in irregular piles as illustrated diagrammatically in FIG. 8. The method of the present invention is particularly adaptable to this type of quenching as the liquid penetrates the bed and passes in a diffusing stream to the bottom, preferably inclined, surface rapidly, where there is a uniform straight line bed of coke for it to attach and cool. As the liquid and associated vapors percolate toward the top of the bed they uniformly, efficiently and quite rapidly quench the whole bed of coke. Where the liquid escapes in a valley between two mounds of coke it splashes on the side of the mound thereby quenching it. Where the liquid rises directly beneath a mound of coke it continues to quench all the way to the surface. It is essential to the invention that a stream of liquid capable of substantial penetration of the bed of coke be employed as opposed to the heretofore employed sprays. Further the discharge means, for example pipes, should be such that there is a minimum of diffusion of the quench liquid before it strikes the bed of coke. In other words the discharge means should be such that there is no substantial breaking up of the quench liquid into droplets as it falls from the discharge means to the surface of the bed of coke. Now, of course, any uncontained liquid falling through a gas will tend to break up into droplets due to surface tension of the liquid. However, if the length of the fall is not too great there will not be much diffusion of the stream before it strikes the bed of coke. In practice it has been found that the distance from the point of discharge to the surface of the bed should be a maximum of 12 feet preferably less than 6 feet, most preferably 6–8 feet, depending on the length to width ratio of the pipe and the velocity of the stream. For streams issuing from pipes with a length to width ratio of 8 and a pressure of 4 psi in the header, a distance of 6 to 8 feet is satisfactory.

It is surprising how deep a bed of hot coke can be penetrated effectively with the stream quenching method of the invention, but generally for ease of handling and most effective control of residual moisture a mean depth of 1 – 6 feet with a maximum point depth of 8 feet is desirable. It is preferred to control the depth of coke to a mean depth of 1 – 3 feet (maximum point depth 4 feet).

The time it takes to quench a car of coke is very important for slot type coke ovens because excessive quench times interfere with pushing schedules. Also, the residual moisture content is related to the amount of time the quench liquid is in contact with the not coke because the 27 – 33 lb/ft$^3$ density coke will rapidly absorb liquid as the hot gases filling the pores contract on cooling leaving a void which is readily taken up by the liquid. In other words, the hot coke sucks up liquid as it is quenched. However, with the distribution of quench liquid obtained when practicing this invention, short quench times of 45 seconds to 1 minute are common and 45 seconds to 1.5 minutes easily obtainable as compared to 1.5 to 3 minutes in conventional spray practice.

The spacing of the streams for quenching can be important for large surface areas of coke as, for example, a hot coke car having a surface area of about 600 square feet. For such large areas there must be a stream to penetrate the bed at least every 5 feet along the length of the car. In other words there should be more than 5 feet between downwardly directed streams. However, when a longitudinal stream is poured from a device as shown in FIG. 4 or from a single pipe as in FIG. 5 sufficient quench liquid reaches the inclined plane of the bottom and moves down to start the percolating action in the evenly distributed lower portion of the bed. Where pipes are positioned over the upper ½ of the surface, however, they should be no more than 5 feet apart and preferably spaced less than 4 feet apart.

It is absolutely essential of this invention that the quench liquid fall in a stream on the bed of coke. As pointed out above this is contrary to the teaching of the prior art which emphasized spraying water in relatively fine droplets over the entire bed of coke. However, this does not mean that a combination of stream flow through the bed of coke and spray over the coke is not within the scope of the invention. In accordance with one embodiment, and particularly as shown in FIG. 4, stream flow on the upper ½ surface is used to obtain the penetration and percolating action while a relatively minor amount of sprayed liquid by conventional sprays 13 is employed on the lower ½ of the bed to meet the upwardly percolating quench liquid. In practice, it is not necessary to spray the lower ½ of the bed as a satisfactory quench can be obtained in about one minute using only stream flow. But in some instances where the upper coke surface is particularly uneven, this technique can prove beneficial.

The pressure on the stream may vary over wide limits but generally speaking pressures higher than about 8 psi in the header are not advantageous. Sufficient quench liquid can be gotten through the coke at or below this pressure and higher pressures tend to unduly disturb the bed of coke causing pieces of it to fly out of the car.

A perforated header is not satisfactory, for the practice of the method of the invention. Perforations without a length of pipe to direct the stream result in a spray of quench liquid over the bed of coke. While a longitudinal stream as with the device of FIG. 4 may be used, most installations will involve a pipe or pipes descending from the header which must have a length at least three times its diameter and preferably eight times. This will create a stream capable of only minimum diffusion in the first 6 feet of fall before it strikes the bed of coke.

The amount of quench liquid, almost invariably water, is somewhat reduced below that currently required by conventional practice, however, this is not nearly as significant as the consistently low residual moisture levels of 2 – 4% by weight of coke obtainable by the method of this invention. The total amount of water applied to the coke usually is about 300 – 800 gallons per ton. In order to penetrate the depth of the bed in a conventional hot coke car where the bed depth is a maximum of about 8 feet, the rate of flow to the "direct contact area" is important. As used herein and in the claims the "direct contact area" means the area directly under the stream. The stream should contact the coke at a rate of about 200 – 600 gallons per square foot of direct contact area per minute. In accordance with one preferred embodiment of this invention all or most quench liquid is directed to the high side of the sloping bottom quench car, preferably the upper ½. By this unconventional and previously unrecognized technique excessive build up of water and flooding of the coke near the gate is substantially prevented and overquenching in that area is reduced. It is possible to achieve satisfactory quenching by putting either multiple streams or a single longitudinal stream onto the upper ½ of the bed of coke without any other application of quench liquid.

Laboratory studies on small quantities of coke have shown that when using a spray nozzle, very little water passes to the coke below the top layer until the top layer is nearly saturated. Thus, the top layer of coke is found to contain 38 – 50% moisture even while the bottom layer is still uncandescent. However, with the stream type impingement of the present invention the volume of water falling upon a portion of the top layer of coke is so great that because of the time dependent absorption of water the top layer could only absorb a fraction of the water available and the excess water rapidly passes to the lower layers.

Tests were conducted by placing the coke from 30 pounds of coal consisting of 75% Pittsburgh seam high volatile and 25% Pocahontas seam low volatile maintained in two pressure test ovens at 2,000° F. The coke was pushed when the thermocouple at the center of the charge reached 1,800° F. This produced about 20 pounds of coke which was placed in an expanded metal basket to give a coke column height of about 18 inches for Examples 1 – 10 shown in Table 1 and to yield 40 pound charges from the ovens by using a basket of about 36 inches in height. The basket had an 8 by 10 inch cross section. Water was applied to the basket of hot coke by spray as indicated in the table and also by pipes of the jet type according to the invention which consisted of a 1 or 1½ inch pipe 6 inches long extending from the bottom of a 55 gallon steel drum. A quick operating valve was provided in each pipe to control the flow. With the basket of coke in position, the valve was opened and the water allowed to flow onto the basket of hot coke. The amount of water used was determined by measuring the difference in height of water in the drum before and after the test. After the measured amount of water was allowed to flow onto the coke and the coke was quenched, it was drained for two minutes. The 18 inch columns were then loosely divided into 2 sections, top and bottom, and the moisture content determined for each section. The 36 inch column was divided into 4 sections and the moisture determined for each. In some cases the basket of coke was moved back and forth under the jet. In other cases the jet was applied intermittently. Tests were conducted with 1,2 and 4 pipes coming form the bottom of the drum. The results of these tests are summarized in Table 1.

Table 1

| Trial No. | Jet or Spray | No. of Jets | Size of Pipes (Std.) | Basket Moved | No. of Applications | Time Between Application (Sec.) | Time of Each Application (Sec.) | Total Time of Application (Sec.) | Total Elapsed Time (Sec.) | Coke Depth (In.) | Coke Wt. (Lbs.) | Amt. of Water (Gal.) | Amt. of Water (Gal./Ton) | Moisture Top-Middle-Bottom-% | | Average Moisture % |
|---|---|---|---|---|---|---|---|---|---|---|---|---|---|---|---|---|
| 1 | J | 2 | 1 | No | 1 | 0 | 12 | 12 | 12 | 17 | 20.5 | 5.4 | 530 | 11.4 | 6.4 | 9.4 |
| 2 | J | 2 | 1 | No | 3 | 40 | 4 | 12 | 120 | 17 | 20.6 | 6.7 | 650 | 35.3 | 40.4 | 37.8 |
| 3 | J | 2 | 1 | No | 7 | 15 | 2 | 14 | 90 | 19.5 | 20.0 | 5.7 | 570 | 50.0 | 54.9 | 52.7 |
| 4 | J | 2 | 1 | No | 7 | 10 | 1 | 7 | 60 | 19.5 | 21.2 | 3.8 | 360 | 46.0 | 41.5 | 43.8 |
| 5 | J | 2 | 1 | No | 5 | 10 | 2 | 10 | 45 | 18 | 20.7 | 3.0 | 287 | 39.8 | 31.8 | 34.8 |
| 6 | J | 2 | 1 | No | 1 | 0 | 5 | 5 | 5 | 18 | 19.0 | 1.9 | 190 | 0.59 | 0.46 | 0.52[2] |
| 7 | J | 2 | 1 | No | 1 | 0 | 8 | 8 | 3 | 18;178 | 21.1 | 3.6 | 342 | 5.2 | 1.3 | 3.1 |
| 8 | J | 2 | 1 | No | 2 | 15/ | 4 & 2 | 6 | 20 | 18½ | 20.8 | 3.4 | 328 | 10.7 | 9.6 | 10.1 |
| 9 | S | 1 | 1[1] | No | 1 | 0 | 30 | 30 | 30 | 18½ | 20.8 | 3.1 | 300 | 38.9 | 15.5 | 26.5 |
| 10 | J | 1 | 1 | No | 1 | 0 | 30 | 30 | 30 | 18½ | 20.7 | 11.3 | 1,060 | 33.3 | 42.7 | 38.7 |
| 11 | J | 2 | 1 | No | 1 | 0 | 20 | 20 | 20 | 36 | 40.2 | 8.1 | 403 | 14.8, 12.4 | 7.7, 6.3 | 9.8 |
| 12 | J | 2 | 1 | Yes | 8 | 10 | 2 | 16 | 80 | 36 | 41.5 | 7.0 | 339 | 50.0, 51.3 | 44.4, 32.2 | 43.8 |
| 13 | J | 2 | 1 | Yes | 10 | 10 | 1 | 10 | 100 | 40 | 41.0 | 4.7 | 229 | 49.3, 45.7 | 28.7 9.3 | 30.5 |
| 14 | J | 2 | 1 | Yes | 1 | 0 | 8 | 8 | 8 | 36 | 40.1 | 3.8 | 190 | 2.2, 1.3 | 0.5, 0.0 | 0.87[3] |
| 15 | J | 2 | 1½ | Yes | 1 | 0 | 9 | 9 | 9 | 36 | 41.6 | 9.6 | 460 | 11.2, 7.3 | 6.2, 3.5 | 6.6[3] |
| 16 | J | 2 | 1½ | Yes | 1 | 0 | 7 | 7 | 7 | 35 | 40.5 | 6.8 | 336 | 1.9, 1.0 | 0.1, 0.0 | 0.8 |
| 17 | S | 1 | 1[1] | No | 2 | 30 | 30 | 60 | 90 | 36 | 41.1 | 6.2 | 301 | 49.5, 52.7 | 47.8, 28.1 | 43.8 |
| 18 | J | 4 | 1½ | Yes | 1 | 0 | 5 | 5 | 5 | 36 | 41.8 | 11.2 | 535 | 4.9, | 0.1, | 2.0[3] |

Table 1-continued

| Trial No. | Jet or Spray | No. of Jets | Size of Pipes (Std.) | Basket Moved | No. of Applications | Time Between Application (Sec.) | Time of Each Application (Sec.) | Total Time of Application (Sec.) | Total Elapsed Time (Sec.) | Coke Depth (In.) | Coke Wt. (Lbs.) | Amt. of Water (Gal.) | (Gal. /Ton) | Moisture Top-Middle-Bottom-% | Average Moisture % |
|---|---|---|---|---|---|---|---|---|---|---|---|---|---|---|---|
| 19 | J | 4 | 1½ | No | 1 | 0 | 12 | 12 | 12 | 36 | 41.7 | 21.5 | 1,030 | 0.2 0.0 13.9, 17.1,[4] 11.9 17.1 | 15.0 |

[1]1" Spray Nozzle
[2]Some Coke at bottom not completely quenched.
[3]Bottom six inches not quenched.
[4]Coke in bottom half smaller than top half.

In a typical commercial scale quench, a quench car 50 feet long by 12 feet wide having a sloping bed at an angle of 30° from the pusher side to the gate side of the car and containing coke to an average depth of about 1.5 feet is pushed beneath a quench tower with said car having an horizontal area of 600 ft² and four longitudinal rows of 1½ inch pipes spaced 3.5 feet apart longitudinally 6 feet above the high side (upper ½) of the coke bed. Water at a rate of 350 gallons per square foot of direct contact area is applied in one minute. A total of 5,000 gallons of water is thus applied. The car of coke is completely quenched in 1 minute and ready to be dumped onto the coke wharf within 2 minutes with no evidence of incandescence.

THE OSCILLATING SYSTEM

The preferred oscillating quench system consists of a single 10-inch header mounted in the tower longitudinally above the centerline of the quench car. The pipe is suspended in bearings at each end and contains twenty-nine 1½-inch vertical pipe outlets on about 20 inch centers in order to accommodate a 50 foot car. If the cars are frequently loaded unevenly, the pipes may be distributed to provide more water in areas of high piling. Water is supplied from swivel connections attached to the header. The pipe is rotated back and forth by means of a double-acting hydraulic cylinder attached to a lever arm at one end of the header. The 29 streams of water make from 2 to 5 passes across the car each way during the 75 second quench. The quench by this method has been complete and moisture has been regularly reported to average about 5 percent.

Figure 9:
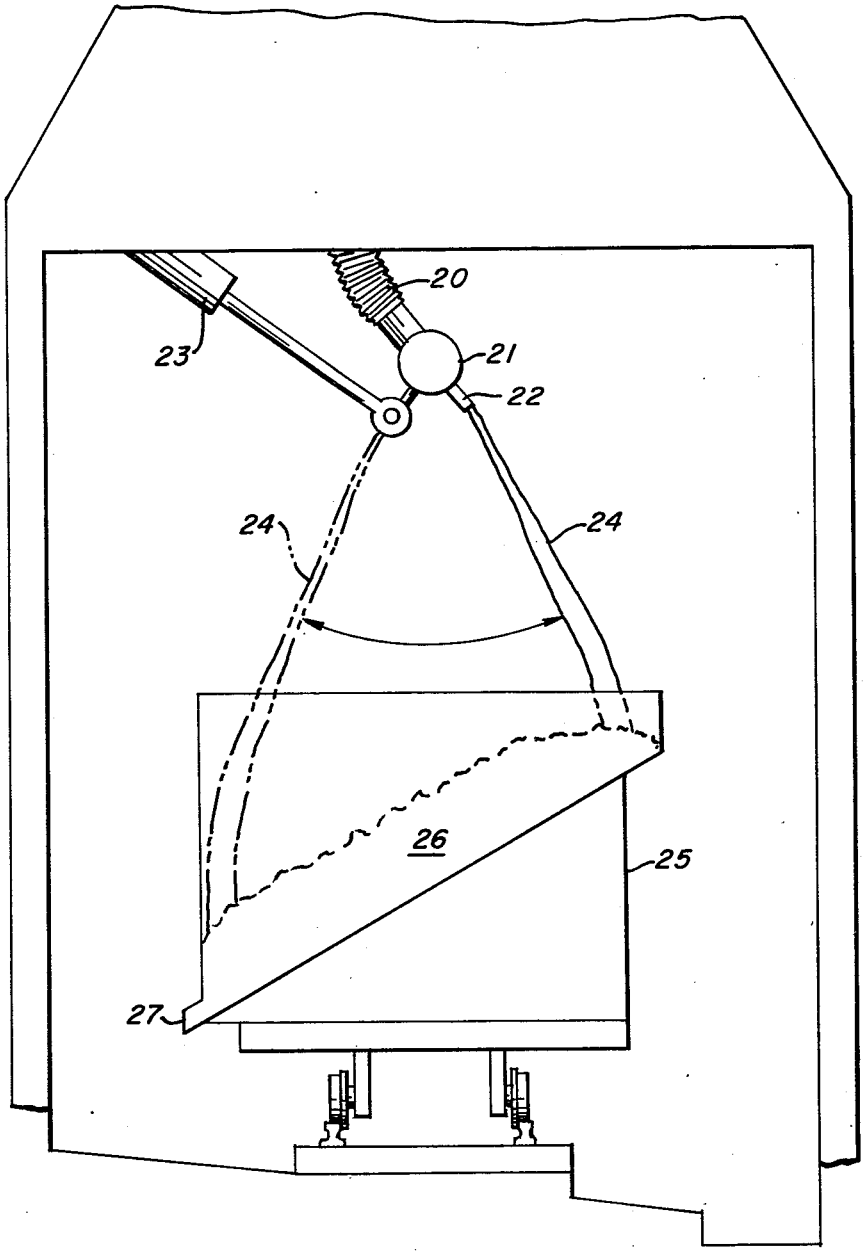
FIG. 9 is a vertical sectional view of an oscillating stream quenching station of the invention showing a hot coke car beneath a row of streams of quench liquid.

Referring to FIG. 9, swivel coupling 20 supplies screened water to header 21 having a row of pipe outlets 22 made of straight standard pipe as previously described for the stationary system. Actuating cylinder 23 causes the header 21 to turn axially, moving the water streams 24 gradually across the quench car 25 containing hot coke 26 and having a bottom drain 27.

The pipe outlets 22 may vary in diameter from 1½ inches to 2 inches and carry water flowing at rates of 50 to 150 gal./min. The oscillations are preferably conducted at a rate of 2 to 5 within 75 seconds, but may vary from 1 to 15 within 2 minutes. Preferably the streams will be directed at the highest point of the coke profile for a period of at least three of every ten seconds; at least five of every 10 is preferred. Stationary flows proportional to these rates may also be used; that is, thirty to fifty percent of the quench time is preferably devoted to the peak of the coke profile and the remainder of the time is devoted to oscillating the more or less solid streams of water over the remainder of the coke surface.

Our quenching system is unique in the small amount of water required. Assuming the delivery of 80 gallons of water from each pipe per minute or 100 gallons in 75 seconds, this amounts to only 2900 gallons per quench or 205 gallons per ton for a 14 ton load. This compares with 400 to 800 gallons per ton at other spray installations.

As good as this performance might seem, our original experimental work indicated that repeated applications of water always produced higher moisture in the coke, particularly at the top, than the same amount applied as one application. Using this philosophy we have conducted a limited number of trials controlling the air cylinder movement manually. Good quenches have been obtained by directing the water toward the top edge of the car (battery side) for 45 seconds to 1 minute and then making only 2 to 4 passes over the rest of the car during the remaining ½ or 1 minutes.

Our system not only results in reduced water usage, thus reducing the problems of waste disposal, but also may distribute water according to coke depth, and provide a consistently low moisture coke.

Although the invention has been described in considerable detail in the foregoing, it is to be understood that such detail is for the purpose of illustration and that many variations can be made by those skilled in the art without departing from the spirit and scope of the invention except as set forth in the claims.

We claim:

1. The method for the rapid liquid quenching of coke which comprises distributing hot coke on a quenching surface having a bottom drain to form a bed of coke and flowing streams of quench liquid from spaced apart pipes through the bed of coke at spaced apart locations so that prior to striking the surface of the coke bed, there is no substantial breaking up of the quench liquid into droplets, and so that the quench liquid penetrates the bed prior to complete vaporization, at least some of it flowing out of the bottom drain, and rapidly quenches the coke while avoiding flooding thereof, as the vapor and liquid percolate through the surrounding bed, and oscillating the stream of quench liquid gradually over the surface of the coke.

2. Method of claim 1 in which the oscillations are conducted at the rate of from 1 to 15 within a period of two minutes.

3. Method of claim 1 in which the stream of quench liquid is applied to the peak of the coke profile for a period of from thirty to fifty percent of the quench time, and oscillated over the remaining surface of the coke for fifty to seventy percent of the quench period.

* * * * *

UNITED STATES PATENT OFFICE

CERTIFICATE OF CORRECTION

Patent No. 4,025,395 Dated May 24, 1977

Inventor(s) LaVerne, G. Ekholm, Bernard R. Kuchta and Joseph P. McGinness

It is certified that error appears in the above-identified patent and that said Letters Patent are hereby corrected as shown below:

Column 1, line 11, change "Not" to -- Hot --;
line 35, change "are" t0 -- more --.

Column 2, line 52, change "an" to -- as --.

Column 4, line 20, change "not" to -- hot --.

Column 6, line 3, change "uncandescent" to -- incandescent --;
line 22, after "spray" insert -- nozzles --.

Table 1:
column 16, line 4, change "43.8" to -- 43.7 --;
column 10, line 7, change "3" to -- 8 --;
column 11, line 7, change "18;178" to -- 18-1/2-
column 11, line 16, change "35" to -- 36 --;
column 16, line 17, change "43.8" to -- 43.5 --.

Footnote 4 of Table 1, change "snmaller" to -- smaller --.

Column 7, line 17, after "typical" insert -- large --.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademark.*